US005307563A

United States Patent [19]

Svenka

[11] Patent Number: 5,307,563

[45] Date of Patent: May 3, 1994

[54] METHOD OF MAKING ROLLS WITH ELASTIC COVERS

[75] Inventor: Peter Svenka, Grefrath, Fed. Rep. of Germany

[73] Assignees: Sulzer Papertec Krefeld GmbH, Krefeld; Ferd. Jagenberg & Söhne GmbH & Co. KG, Altenkirchen, both of Fed. Rep. of Germany

[21] Appl. No.: 76,985

[22] Filed: Jun. 15, 1993

[30] Foreign Application Priority Data

Jun. 19, 1992 [DE] Fed. Rep. of Germany ..... 4219989

[51] Int. Cl.[5] ..... B23P 15/00

[52] U.S. Cl. ..... 29/895.213; 29/895; 492/40

[58] Field of Search ..... 29/895.213, 895.21, 29/895.2; 264/136, 162, 248; 492/39, 40, 45

[56] References Cited

U.S. PATENT DOCUMENTS

| | | | |
|---|---|---|---|
| 2,801,461 | 8/1957 | Kusters | 29/895.213 |
| 3,383,749 | 5/1968 | Wilkinson | 29/895.213 |
| 3,814,054 | 6/1974 | Sajihi | 29/895.213 |
| 4,475,275 | 10/1986 | Edwards | 29/895.213 |
| 4,583,966 | 4/1986 | Ocker et al. | 29/895.213 |
| 4,669,163 | 6/1987 | Lux et al. | 29/895.213 |
| 5,033,317 | 7/1991 | Van Haag | 73/862.54 |
| 5,038,469 | 8/1991 | Masuda et al. | 29/895.213 |
| 5,097,596 | 3/1992 | Hoogesteger et al. | 29/895.213 |

*Primary Examiner*—Irene Cuda
*Attorney, Agent, or Firm*—Darby & Darby

[57] ABSTRACT

A roll which has a metallic core and an elastomeric envelope is obtained by assembling the cover from a stack of discs each of which surrounds the core. In order to impart to the cover a desired elasticity, the discs contain a fibrous material and a plastic substance and are pressed against each other in the longitudinal direction of the core. The plastic substance is hardenable within an interval exceeding 48 hours. The pressing step is started with a delay following the step of placing the discs around the core such that the hardening begins prior to compressing and is terminated within an interval not less than 48 hours following the start of the pressing step.

14 Claims, 1 Drawing Sheet

METHOD OF MAKING ROLLS WITH ELASTIC COVERS

BACKGROUND OF THE INVENTION

The invention relates to a method of making rolls of the type used in calenders and analogous machines. More particularly, the invention relates to improvements in methods of making rolls of the type wherein an elongated core is surrounded by an elastomeric envelope and the envelope includes at least one stack of thin discs.

German Pat. No. 10 71 036 discloses a method of making calender rolls which includes welding the discs to each other subsequent to placing of the discs around a core. The discs are made of fleece and contain a bonding agent, such as latex, in a partially vulcanized state. The first step involves the placing of discs around the core and the discs are thereupon pressed against each other with a substantial force. The core and the thus obtained envelope (consisting of pressed-together discs) are thereupon heated for an extended period of time in order to complete the vulcanizing of the bonding agent. The heating step involves subjecting the discs and the partially vulcanized bonding agent to temperatures in the range of 100°-120° C. for a period of 5-8 hours. The thus obtained envelope has a hardness in the range of 90-97 Shore A. A role which embodies an envelope of the just outlined character can be used as a means for squeezing liquids from leather, textile materials and the like or as a counterrole in embossing and like machines.

A drawback of the aforedescribed rolls is that they cannot be put to use in supercalenders and/or compact calenders, for example, in calenders which are used as a means for smoothing the exposed surfaces of webs of paper, webs of fleece, magnetic tapes, webs of textile material and the like. In such calenders, the rolls contain elastic envelopes which surround a solid shaft or a hollow cylinder made of steel or grey cast iron. The hardness of the envelope forming part of a roll for use in a supercalender or a compact calender must exceed the aforementioned values.

European Pat. No. 0 131 083 B1 proposes to use primarily chemical pulp in the discs of rolls of calenders or the like. For example, an envelope which forms part of a roll satisfying the European standards concerning elastic calender rolls contains 80 percent cotton and 20 percent wool. However, it is also known to employ envelopes which contain up to 50 percent asbestos fibers or up to 15 percent carbon fibers. The characteristics of the roll depend on the ratio of various fibers in its envelope. For example, the resistance of an envelope to permanent deformation (marking) can be increased by increasing the percentage of animal wool, i.e., such envelope is less likely to undergo permanent deformation as a result of repeated engagement with pleats, folds or other accumulations of material in a running web of paper or the like. On the other hand, an increase in the percentage of animal wool entails a reduction of hysteresis and attendant pronounced heating simultaneously with a reduction of the ability to stand mechanical stresses. This eliminates such rolls from use under elevated stresses, namely at high speeds and at pronounced line loads.

The ability of a roll to stand elevated temperatures is also an important factor when the envelope develops heat due to hysteresis and also because a roll having an elastic envelope is heated due to transfer of heat from a companion roll which cooperates with the roll having an elastic envelope to define therewith a nip for a running web of paper or the like. Reference may be had to U.S. Pat. No. 2,987,802 which discloses a method of mixing pulp in a paper making machine with a duroplastic substance. The paper web which is obtained from such mixture is heated to a temperature of 290°-300° C. for a period of 6-10 minutes prior to cutting of discs from the web.

OBJECTS OF THE INVENTION

An object of the invention is to provide a method of making an improved elastic cover for use in the rolls of calenders and like machines.

Another object of the invention is to provide a method of making an elastic cover which can stand pronounced mechanical and/or thermal stresses without undergoing permanent deformation.

A further object of the invention is to provide a novel method of making improved rolls for use in calenders and like machines.

An additional object of the invention is to provide a novel and improved method of making discs for use in elastic covers of calender rolls.

Still object of the invention is to provide a novel and improved method of treating stacks of paper discs for the purpose of converting such stacks into elastic covers of rolls for calenders and like machines.

A further object of the invention is to provide an elastic cover which is obtained in accordance with the above outlined method.

Another object of the invention is to provide a novel and improved roll for use in calenders and like machines.

SUMMARY OF THE INVENTION

The invention resides in the provision of a method of making a roll which, when finished, has an elongated core (e.g., a core made of steel) and an elastic cover including a plurality of discs containing a fibrous material and a hardenable plastic substance whose hardening requires a time span exceeding 48 hours. The improved method comprises the steps of placing the discs of the cover next to each other around the core, and subjecting the thus obtained cover to a compressive stress in the longitudinal direction of the core. The step of subjecting the cover to a compressive stress includes starting the compressing step with a delay following the placing step such that the hardening of the plastic substance begins prior to the subjecting step and is terminated within an interval of more than 48 hours following the start of the processing step, i.e., a portion of the aforementioned time span takes place prior and a portion (lasting at least 48 hours) of the time span takes place subsequent to starting of the compressing step.

The subjecting step can be carried out at least substantially without heating of the plastic substance.

The hardening of the plastic substance can begin within a period which immediately precedes and is shorter than the aforementioned interval. The method can be practiced in such a way that the hardening of plastic material takes up a time span including and exceeding the aforementioned interval, and the interval amounts to at least 75 percent of the entire time span. The interval can be longer than one week, e.g., between two and four weeks.

The method can further comprise the step of making the discs in a specific way, namely in a paper making machine and including admixing the plastic substance to paper pulp prior to conversion of pulp into discs. Such method can further comprise making a moist web from the mixture of paper pulp and plastic substance and reducing the moisture content of the web including heating the web for a short period of time to a temperature of approximately 100° C.

Alternatively, the step of making the discs can comprise making a web from pulp, impregnating the web with the plastic substance, and separating discs from the impregnated web.

At least some of the discs can contain between 5 and 40% by weight (preferably between 20 and 30% by weight) of plastic substance.

For example, the plastic substance can contain a water-dispersible epoxy system and a slow accelerator, e.g., an accelerator which contains or consists of polyaminoamine.

The novel features which are considered as characteristic of the invention are set forth in particular in the appended claims. The improved method itself, however, together with additional features and advantages thereof, will be best understood upon perusal of the following detailed description of certain presently preferred specific embodiments of a calender roll which is obtained in accordance with the improved method and is shown in the accompanying drawings.

DESCRIPTION OF THE PREFERRED EMBODIMENTS

Figure 1:
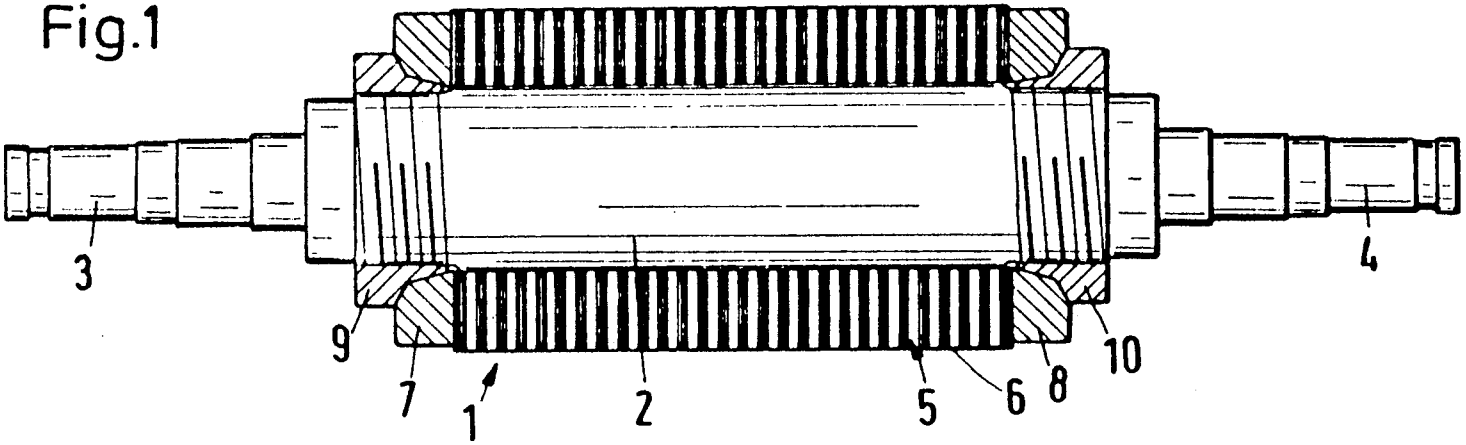
FIG. 1 is a partly elevational and partly axial sectional view of a roll which is constructed and assembled in accordance with the method of the present invention.
Figure 2:
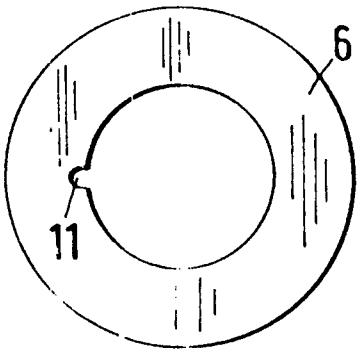
FIG. 2 is a front elevational view of a disc which is utilized in the cover of the roll shown in FIG. 1.

The roll 1 which is shown in FIG. 1 comprises an elongated cylindrical core 2 of steel and an elastic cover or envelope 5 which surrounds the median portion of the core and is assembled of discs 6 of the type shown in FIG. 2. The end portions 3, 4 of the core 2 are designed to be journalled in the frame of a web treating machine, such as a calender, for example, in a manner as disclosed in commonly owned U.S. Pat. No. 5,033,317 granted Jul. 23, 1991 to Rolf Van Haag. The discs 6 contain a fibrous material and a plastic substance which is hardened in accordance with the method of the present invention. The cover 5 is subjected to a compressive stress in the axial direction of the core 2 by two rings 7, 8 which abut the two outermost discs 6 and are maintained in the illustrated axial positions by two nuts 9, 10 mating with externally threaded portions of the core 2. The internal surfaces of the discs 6 are provided with notches 11 (FIG. 2) for a complementary external axially parallel rib (not shown) of the core 2 so that the envelope 5 and the core cannot turn relative to each other.

The discs 6 can be stamped or otherwise removed from a continuous web which is turned out by a standard paper making machine. The major portion of each disc 6 consists of a fibrous material, such as cotton fibers. However, it is equally possible to employ synthetic plastic fibers, mineral fibers, carbon fibers or animal fibers (such as wool) or a mixture of two or more different types of fibers. For example, the range of elasticity of the cover 5 can be enhanced if the discs 6 contain a mixture of cotton fibers with synthetic plastic and/or mineral fibers; this is desirable when the roll 1 is used in a calender for the processing of paper webs because the envelope 5 can readily yield and thereupon reassume its original shape when it encounters a lump or a fold or pleat in a running web. It is further possible to make the disc 6 of a material which includes plastic fleece or synthetic plastic paper without any or with a small percentage of cotton fibers.

The discs 6 further contain between 5 and 40 percent by weight of a hardenable synthetic plastic substance. For example, the plastic substance can be admixed to pulp in the paper making machine prior to conversion of pulp into a web which yields the discs 6. The plastic substance is a cold setting or hardening substance having an accelerating component selected in such a way that the cross-linking speed is very low, namely such that the hardening of the plastic substance is completed within an interval of at least two days (particularly between two days and four weeks) following the application of compressive stress by the rings 7 and 8. The arrangement is preferably such that the interval of hardening of plastic substance following the application of compressive stress is at least 75 percent of the time span which is required to complete the hardening of the plastic substance. Thus, a relatively short portion of such time span elapses prior to and the relatively long interval (not less than 48 hours) of the time span elapses subsequent to the application of compressive stress by the rings 7 and 8.

A presently preferred plastic substance consists of or contains a water-dispersible epoxy system and a slow accelerator, such as polyaminoamine.

Once the roll 1 is assembled in a manner as shown in FIG. 1, it is merely necessary to permit the accelerator of the plastic substance to ensure adequate hardening of the epoxy system (for a period of preferably not less than 48 hours and up to or even in excess of four weeks) and the envelope 5 then exhibits the desirable elastic properties for use in a calender or a like machine. The thus obtained cover 5 is homogeneous and can be used in machines wherein the roll 1 must be rotated at a high speed and/or must transmit and stand elevated pressures. Furthermore, the envelope 5 is capable of resisting pronounced stresses which would cause permanent deformation of the peripheral surface of a standard roll.

It is desirable and important to ensure that the cross-linking take place at or close to room temperature, i.e., that no substantial or pronounced cross-linking reactions take place due to or as a result of heating. Thus, no pronounced temperature changes take place during cross-linking which, in turn, ensures that different reactions (and hence different properties of the material of the cover 5) do not develop during cross-linking. This is important because different properties in different portions of a finished cover could lead to cracks, tears and/or other damage. Moreover, the method is simple because it need not include a heating step during or preparatory to hardening of the plastic substance. All that is necessary is to permit an otherwise finished roll 1 to await complete hardening (not less than 48 hours) of the plastic substance upon completion of the compressing step.

In actual practice, a certain period of time will elapse between the application of plastic substance to the fibrous material and the start of the roll making operation. Since the hardening of the plastic substance is slow, the period between the application of plastic substance to the fibrous material and the making of an cover 5 is a relatively small fraction of the entire time span which is required to ensure adequate hardening of the plastic substance. A very substantial part of the hardening step takes place not only within the discs 6 but also between the abutting surfaces of the discs which are biased against each other by the rings 7 and 8. When the hardening is completed, the resulting cover 5 is a homogeneous body which exhibits a highly satisfactory hardness as well as elasticity such as is necessary to take up anticipated loads as well as excessive loads (i.e., those which could damage or destroy the cover of a conventional roll) without undergoing permanent deformation. Thus, the cover of the improved roll can stand stresses which cause shifting of discs, bulging and/or other damage to a conventional roll. This, in turn, ensures that a roll which is produced in accordance with the improved method does not undergo permanent deformation.

It is already known to regulate the speed of hardening of a cold-hardening plastic substance by properly selecting the nature and the quantity of the accelerator. In accordance with the present invention, the accelerator of the plastic substance is selected in such a way that the making of a starting material (including the fibrous material and the plastic substance), the stamping or other separation of discs 6 from the starting material, the stacking of discs 6 around the median portion of the core 2, and the compressing of discs 6 which form the cover 5 take up only a portion of the entire time span which is required for hardening of the plastic substance. This leaves a sufficiently long interval of time for hardening upon completion of the compressing step. As already mentioned above, the period of hardening prior to completion of the compressing step need not amount to 25 percent of the entire time span for hardening so that the interval of hardening subsequent to the compressing step can amount to not less than 75 percent of the entire time span. The aforementioned interval can last for one full week or even longer, e.g., between two and four weeks.

The presently preferred step of making the discs 6 involves mixing paper pulp in a paper making machine with the plastic substance and thereupon converting the mixture into a web serving as a blank for removal (e.g., by stamping) of discs 6 therefrom. The fact that hardening begins as soon as the plastic substance is admixed to the pulp is of no consequence because the total span of hardening is long and any hardening which takes place prior to completion of the compressing step is still a fraction of the total hardening which is required to complete the making of the cover 5. However, and as also mentioned hereinbefore, the period of hardening prior to completion of the compressing step can be shortened or reduced to zero by the simple expedient of making the discs 6 from paper pulp and by thereupon impregnating such discs with the plastic material, i.e., by ensuring that hardening of plastic material cannot begin prior to stacking of the discs 6 on the core 2.

The interval of hardening upon application of compressive stress can take up to the entire time span which is needed for full hardening of the plastic substance.

Figure 3:
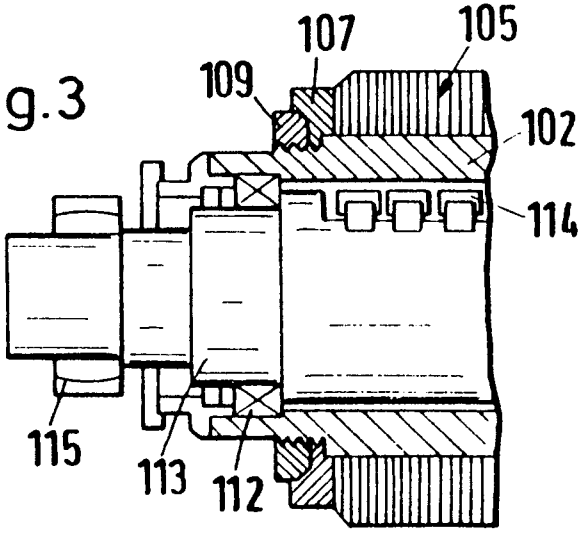
FIG. 3 is a fragmentary partly elevational and partly axial sectional view of a modified roll.

FIG. 3 shows a portion of a second roll wherein the solid core 2 of FIG. 1 is replaced with a modified core in the form of a hollow cylindrical shell 102. The cover 105 (consisting of a stack of discs), the rings (only the ring 107 is shown) and the nuts (only the nut 109 is shown) surround the cylindrical shell 102. The latter surrounds and is rotatable relative to a carrier 113 which is non-rotatably installed in bearings 115 provided in the frame of a calender or an analogous machine. The cylindrical shell 102 is rotatable around antifriction bearings 112 and selected portions of such shell can be straightened out or deformed by selected hydrostatic supporting elements 114. Reference may be had again to commonly owned U.S. Pat. No, 5,033,317 to Van Haag, the disclosure of which is incorporated herein by reference.

As already mentioned above, instead of admixing the plastic substance to paper pulp prior to making of a web which yields the discs 6 or 106, it is also possible to make the web from paper pulp and to thereupon impregnate the web with the plastic substance prior to the making of discs 6 or 106. The moisture content of the web can be reduced prior to the making of discs 6 or 106, e.g., by heating the mixture of pulp and plastic substance for a short interval of time to a temperature of approximately 100° C. Such heating takes place prior to compression of the stack of discs 6 or 106.

An important advantage of the improved method is that the material of the discs 6 or 106 need not be heated in the course of the hardening step. In other words, the temperature of the discs need not be raised above room temperature. As used herein, the term "room temperature" is intended to embrace primarily room but also outdoor temperatures.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. A method of making a roll having an elongated core and an elastic cover including a plurality of discs containing a fibrous material and a plastic substance which is hardenable within a time span exceeding 48 hours, comprising the steps of placing the discs of the cover next to each other around the core; and subjecting the thus obtained cover to a compressive stress in the longitudinal direction of the core, including starting the application of said compressive stress with a delay following the placing step such that the hardening of said plastic substance begins prior to said subjecting step and is terminated within an interval of more than 48 hours following the start of the processing step.

2. A method of making a roll having an elongated core and an elastic cover including a plurality of discs containing a fibrous material and a plastic substance which is hardenable within a time span exceeding 48 hours, comprising the steps of placing the discs of the cover next to each other around the core; and subjecting the thus obtained cover to a compressive stress in the longitudinal direction of the core, wherein carrying out of said subjecting step is at least substantially without heating of the plastic substance, including starting the application of said compressive stress with a delay following the placing step such that the hardening of said plastic substance begins prior to said subjecting step and is terminated after an interval of more than 48 hours following the start of the compressing step.

3. The method of claim 2, wherein the hardening of said plastic substance begins within a period immediately preceding and being shorter than said interval.

4. The method of claim 2, wherein the hardening of said plastic material takes up a period including said interval and said interval amounts to at least 75 percent of said period.

5. The method of claim 2, wherein said interval is longer than one week.

6. The method of claim 2, wherein said interval is between two and four weeks.

7. The method of claim 2, further comprising the step of making said discs in a paper making machine including admixing said plastic substance to paper pulp.

8. The method of claim 7, wherein said making step further includes making a moist web from the mixture of paper pulp and plastic substance and reducing the moisture content of the web including heating the web for a short period of time to a temperature of approximately 100° C.

9. The method of claim 2, further comprising the step of making said discs including making a web from pulp, impregnating the web with said plastic substance, and separating discs from the impregnated web.

10. The method of claim 2, wherein at least some of the discs contain between 5 and 40% by weight of plastic substance.

11. The method of claim 2, wherein at least some of the discs contain between 20 and 30% by weight of plastic substance.

12. The method of claim 2, wherein said plastic substance contains a water-dispersible epoxy system and a slow accelerator.

13. The method of claim 12, wherein the slow accelerator contains a polyaminoamine.

14. A method of making a roll having a elongated core and an elastic envelope including a plurality of discs containing a fibrous material and a plastic substance which is hardenable within a time span exceeding 48 hours, comprising the steps of placing the discs of the envelope next to each other around the core; and subjecting the thus obtained envelope to a compressive stress in the longitudinal direction of the core, including starting the application of said compressive stress with a delay following the placing step such that the hardening of said plastic substance begins prior to said subjecting step and is terminated after an interval of more than 48 hours following the start of the compressing step.

* * * * *